United States Patent [19]

Iseki

[11] 4,347,645

[45] Sep. 7, 1982

[54] SELF CLOSING HINGE

[75] Inventor: Kazuo Iseki, Tokyo, Japan

[73] Assignee: Ohta Company Limited, Tokyo, Japan

[21] Appl. No.: 178,427

[22] Filed: Aug. 15, 1980

[30] Foreign Application Priority Data

Aug. 18, 1979 [JP] Japan ..... 52-113966 [U]
May 6, 1980 [JP] Japan ..... 55-61637 [U]

[51] Int. Cl.[3] ..... E05F 1/12
[52] U.S. Cl. ..... 16/291
[58] Field of Search ..... 16/278, 291, 50, 385

[56] References Cited

U.S. PATENT DOCUMENTS

| | | | |
|---|---|---|---|
| Re. 28,786 | 4/1976 | MacDonald | 16/291 |
| 3,600,743 | 8/1971 | Meadows | 16/291 |
| 3,613,151 | 10/1971 | Anderson et al. | 16/291 |

*Primary Examiner*—Werner H. Schroeder

*Assistant Examiner*—Andrew M. Falik

*Attorney, Agent, or Firm*—John C. Smith, Jr.

[57] ABSTRACT

A hinge comprises an L-shaped stationary flap having a pair of legs each having a rounded, tubular end, an L-shaped rotatable flap having a leg formed with a rounded, tubular end aligned with the tubular ends of the stationary flap, and disposed between the legs of the stationary flap, and a hinge pin extending through the tubular ends of the flaps, and about which the rotatable flap is rotatable. A pair of oppositely directed cam shafts project from the opposite extremities of the tubular end of the rotatable flap and are each received in a recess formed in each leg of the stationary flap. Each cam shaft has a flat surface, and each recess of the stationary flap accommodates a cam rest and a spring urging the cam rest outwardly to maintain it in intimate contact with the flat surface of the cam shaft, whereby the door to which the hinge is attached is closed automatically, and kept in its closed position.

4 Claims, 8 Drawing Figures

FIG. 1
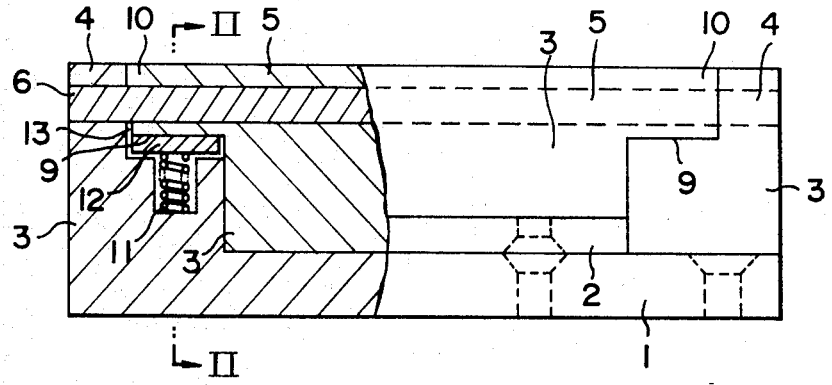
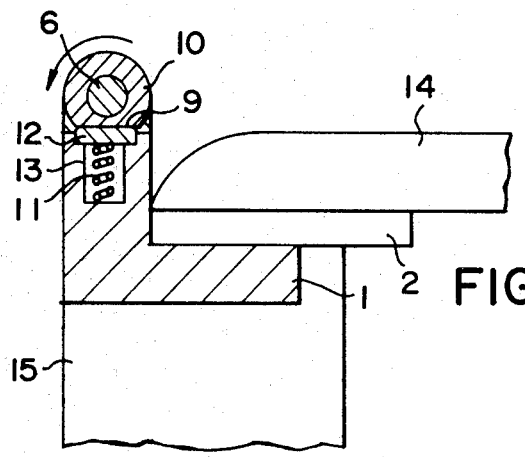
FIG. 2
FIG. 3
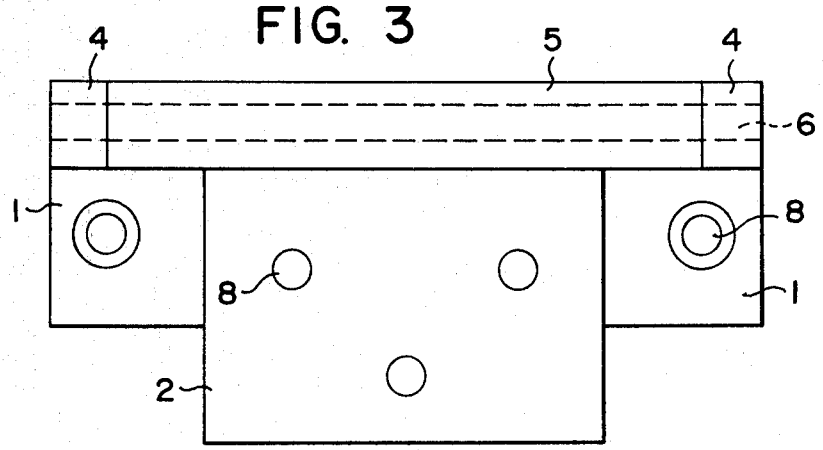

SELF CLOSING HINGE

BACKGROUND OF THE INVENTION

1. Field of the Invention

This invention relates to hinges, and more particularly, to hinges for furniture which can bring themselves to their closed position automatically, and which allows for fine positional adjustment for installation.

2. Description of the Prior Art

Hinges of this type known in the art comprise a pair of thin metal sheets having a thickness of about 1.5 mm, and each having one edge folded over itself to form a rounded, tubular portion. The tubular portions are aligned with one another, and a hinge pin extends therethrough. The tubular portions include a rotatable tubular portion formed with a recess in which a cam rest is resiliently press fitted, so that the door to which the hinges are attached may be closed automatically. The pressure of a spring is held against a spring seat projecting from a stationary flap. See Japanese Patent Publications Nos. 50/1971 and 42313/1972, and Utility Model Publications Nos. 419/1969 and 29179/1972.

As these hinges are usually made by stamping and folding sheet metal in a pressing machine, they have considerable dimensional variation, and often fail to work properly. The cut edge of sheet metal is likely to damage the cam rest, resulting in failure of the hinge. The spring seat, which comprises a thin sheet metal projection is unable to support a heavy spring; therefore, those hinges known in the art have not been applicable to heavy doors.

Known hinges have been of such construction that they are mounted to a wall or the like by a single mounting base and a mounting arm having a channel-shaped cross section, and extending slidably over the mounting base. The mounting arm is movable only longitudinally of the mounting base, as shown in Japanese Utility Model Publication No. 47177/1978, or Laid-Open Utility Model Specification No. 91567/1979. Japanese Utility Model Publication No. 1966/1977 proposes a hinge member having a forked mounting arm, and mounted slidably on a fixed base. This hinge member is movable longitudinally of the fixed base, but immovable in a direction perpendicular thereto. There have been proposed hinge members which are movable both longitudinally and in a direction perpendicular thereto, as disclosed in Japanese Patent Publication No. 25771/1977, and Laid-Open Utility Model Specifications Nos. 64972/1978 and 77260/1978, but none of them can be secured firmly after adjustment, and can withstand violent use for a long period of time.

SUMMARY OF THE INVENTION

According to this invention, there is provided a hinge comprising a stationary flap and a rotatable flap which are each of the L-shaped cross-sectional construction and include a pair of legs and a single leg, respectively. The leg of the rotatable flap is disposed between the legs of the stationary flap, the legs of the flaps being formed therethrough with holes which are aligned axially with one another and through which a hinge pin extends to support the rotatable flap rotatably about it. The leg of the rotatable flap is formed with a pair of oppositely directed cam shafts extending along the hinge pin and each has a flat surface. Each leg of the stationary flap has a recess in which one of the cam shafts is received, and which accommodates a spring and a cam rest urged outwardly by the spring to maintain its contact with the cam shaft.

According to this invention, there is also provided a hinge comprising a stationary base adapted for mounting directly to a furniture wall and formed centrally with an opening in which is fitted a central insert having a smaller width than the central opening. Each of the transverse edges of the central opening has an inwardly directed projection formed with a downwardly facing groove and each of the transverse edges of the central insert is formed with a projection engaged with the groove along one of the transverse edges of the opening. The stationary base is formed with a pair of arm receiving grooves extending along the longitudinal edges of its central opening and has a plurality of teeth formed therein. An L-shaped arm having a bifurcated portion is received in the arm receiving grooves of the stationary base and is formed with a plurality of teeth which engages with the teeth on the stationary base. A pair of screws extend through an elongated slot defined by the bifurcated portion of the arm into a pair of internally threaded holes formed in the central insert, whereby the L-shaped arm is secured to the stationary base movably in four directions for fine positional adjustment.

It is, therefore, an object of this invention to provide a hinge which eliminates the aforementioned drawbacks of the prior art, and which is strong enough for use over a long period.

It is another object of this invention to provide a highly durable hinge which is easy to mount and adjust in position.

Other objects, advantages and features of this invention will become more fully apparent from a detailed consideration of the arrangement and construction of the constituent parts as set forth in the following specification taken together with the accompanying drawings.

BRIEF DESCRIPTION OF THE DRAWINGS

FIG. 1 is a front elevational view, partly in section, of a hinge embodying this invention;

FIG. 2 is a side elevational view, partly in section, of the hinge shown in FIG. 1;

FIG. 3 is a top plan view of FIG. 1;

DETAILED DESCRIPTION OF THE PREFERRED EMBODIMENTS

Figure 4:
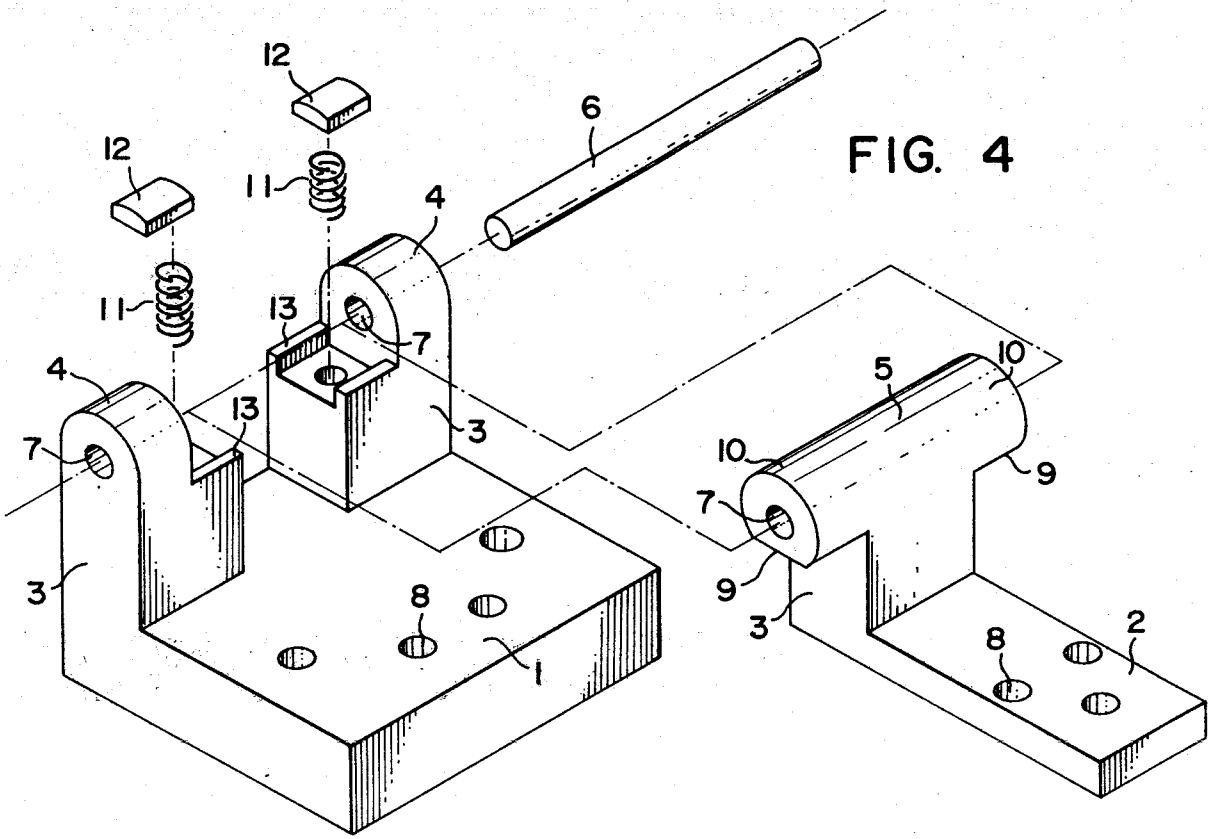
FIG. 4 is an exploded perspective view of the hinge shown in FIG. 1.
Figure 7:
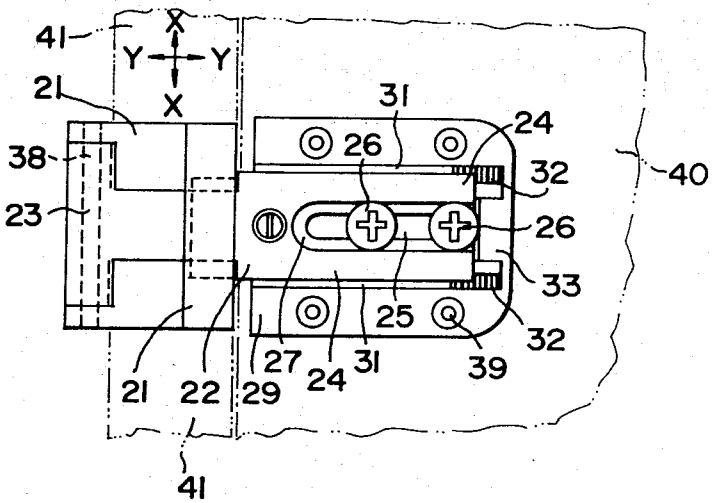
FIG. 7 is a front elevational view of FIG. 5.
Figure 5:
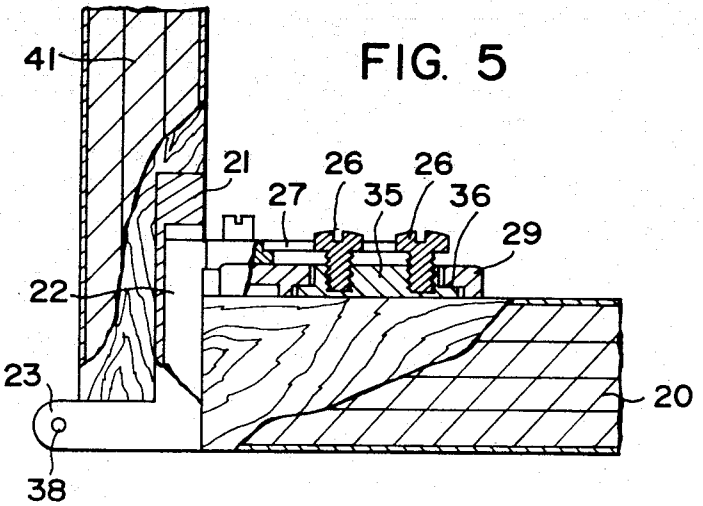
FIG. 5 is a side elevational view, partly in section, of another embodiment of the hinge of this invention as mounted to a box.

Referring first to FIGS. 1 to 4 of the drawings, there is shown a hinge embodying this invention, and which comprises a stationary flap 1 having a pair of legs 3, and a rotatable flap 2 having a leg 3. Each leg 3 of the stationary flap 1 has a tubular end 4 formed with an axial hole 7, while the leg 3 of the rotatable flap 2 is likewise formed with a tubular end 5 having an axial hole 7 therethrough which is aligned with the axial holes 7 of the tubular ends 4 on the stationary flap 1. A hinge pin 6 extends through the axial holes 7 of the stationary and rotatable flaps 1 and 2, so that the rotatable flap 2 is rotatable about the hinge pin 6. The stationary and rotatable flaps 1 and 2, including their respective legs 3, comprise both members of the L-shaped construction as best shown in FIG. 4, and are provided with a plurality of holes 8 through which screws are inserted for mounting the hinge to a wall or door. The leg 3 of the rotatable flap 2 is disposed between the legs 3 of the stationary flap 1. A pair of cam shafts 10 each having a flat surface 9 project in opposite directions from the tubular end 5 of the rotatable flap 2, and the hole 7 extends through the cam shafts 10. Each leg 3 of the stationary flap 1 has a recess in which one of the cam shafts 10 is received, and in which the leg 3 is formed with a groove 13 for accommodating therein a coil spring 11 and a cam rest 12 having an arcuate top surface on which the cam shaft 10 rests. The cam rest 12 is normally urged by the coil spring 11 outwardly into contact with the cam shaft 10. The cam rests 12 are preferably made of a synthetic resin, such as nylon. When the rotatable flap 2 is placed on the stationary flap 1, the flat bottom surfaces 9 of the cam shafts 10 are brought into intimate contact with the top surfaces of the cam rests 12, as shown in FIGS. 1 and 2. Numerals 14 and 15 denote a door and a column, respectively, to which the hinge is mounted (FIG. 2).

If the rotatable flap 2 is rotated in the direction of an arrow in FIG. 2, the left half of the flat surface 9 of each cam shaft 10 presses down the top surface of the cam rest 12, and compresses the coil spring 11. When the left edge of the flat surface 9 has passed the center of the top surface of the cam shaft 10, the distance between the center of rotation of the flap 2 and the top surface of the cam rest 12 becomes constant, and the cam shaft 10 ceases to compress the coil spring 11 to any further extent, so that it becomes possible to continue rotating the flap 2 with a light force.

The rotatable flap 2 is rotated in the opposite direction if it is desired to return it to its initial position to close the door 14. As soon as the left edge of the flat surface 9 of the cam shaft 10 has passed the center of the top surface of the cam rest 12, the coil spring 11 begins to urge the cam rest 12 upwardly, and the cam shaft 10 continues rotation automatically under the action of the coil spring 11 until its flat bottom surface 9 is brought into intimate contact with the top surface of the cam rest 12, whereupon its rotation is discontinued, whereby the door 14 is fully closed.

The construction and operation of the hinge according to this invention as hereinabove described and shown in the drawings provide a number of advantages over any hinge of this type known in the art, as follows:

(a) The hinge has a sharply improved strength along the longitudinal axes of the springs, since the stationary and rotatable flaps 1 and 2 are both of the integral L-shaped construction, and the legs 3 of the stationary flap 1 support the cam rests 12 which are outwardly urged by the coil springs 11, so that the hinges of this invention may have a long operating life on a heavy furniture door when serving to maintain the door firmly in its closed position; and (b) The hinge of this invention can work very smoothly for a long period of time without causing any disorder in operation due to any damage on the cam rests 12, because the top surface of each cam rest 12 is adapted for planar, intimate contact with the flat bottom surface 9 of the cam shaft 10, as opposed to the prior art arrangement in which the rotatable tubular portion is formed with a recess in which the cam rest is forced under the action of the spring, or of which the cam rest is forced out against the action of the spring by rotating the rotatable flap.

The hinge of this invention is preferably formed from drawn or extruded brass, aluminum or like material, but it is equally possible to use cast material, if careful consideration is given to its dimensional accuracy.

Attention is now directed to FIGS. 5 to 8 showing another type of hinge according to this invention, which is highly durable, and easy to mount and adjust in position relative to a furniture wall to which it is directly attached.

The hinge shown in FIGS. 5 to 8 comprises an L-shaped arm 22 having a tubular end 23 hinged to a mounting member 21 on a door 41 as in the case of a known offset hinge. The arm 22 includes a bifurcated portion 24 defining an elongated slot 25 extending in the direction of arrows Y—Y (FIG. 8) perpendicularly to the longitudinal axis of the tubular end 23. The slot 25 has an open end remote from the tubular end 23. The slot 25 has a width which is slightly greater than the diameter of the studs of mounting screws 26, and is provided with a pair of longitudinally extending shoulders 27 on which the heads of the screws 26 rest. Each leg of the bifurcated portion 24 is provided with a plurality of teeth 28 on the bottom surface of its free end.

The hinge further includes a stationary base 29 provided centrally with a generally rectangular opening 30. The base 29 is formed with a pair of arm receiving grooves 31 extending along the longitudinal edges of the opening 30 in the direction of the arrows Y—Y shown in FIG. 8. The base 29 is formed with a plurality of teeth 32 in each of the grooves 31 at its end remote from the tubular end 23 of the arm 22. The opposite ends of the grooves 31, which are closer to the tubular end 23 of the arm 22, are open. The base 29 has a pair of projections 33 along the transverse edges of the opening 30 which are perpendicular to the direction of the arrows Y—Y. Each projection 33 is formed at its bottom with a downwardly facing groove 34. The outer walls of the arm receiving grooves 31 have a distance W' therebetween which is somewhat greater than the width w' of the bifurcated portion 24 of the arm 22.

Figure 8:
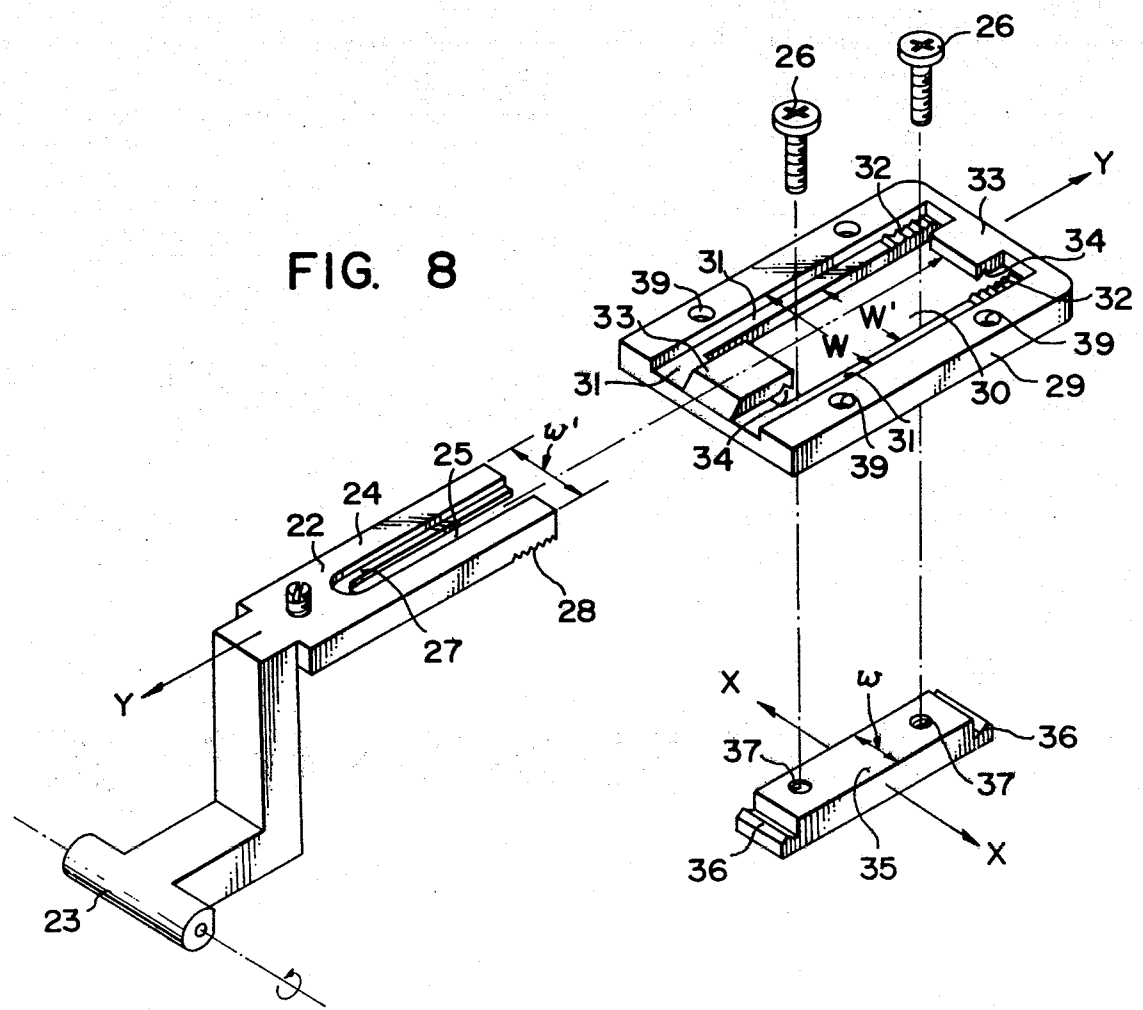
FIG. 8 is an exploded perspective view of the hinge shown in FIG. 5.

The hinge further comprises a central insert 35 fitted in the central opening 30 of the stationary base 29, and having a pair of upwardly directed projections 36 formed along its transverse edges in the direction of arrows X—X perpendicular to the direction of the arrows Y—Y (FIG. 8). The projections 36 are so shaped and positioned that they may engage with the downwardly facing grooves 34 of the stationary base 29 when the central insert 35 is fitted in the stationary base 29 at the bottom thereof. While the drawings show a single projection and a single complementary groove both having a triangular cross-section along each transverse edge of the opening 30, it is equally possible to provide one or more projections 36 and a corresponding number of grooves 34 which may both have another cross-sectional shape, such as semicircular and rectangular. Accordingly, the central insert 35 is slidable only in the direction of the arrows X—X transversely of the opening 30. The central insert 35 is provided with a pair of internally threaded holes 37 into which a pair of mounting screws 26 extend through the slot 25 of the bifurcated portion 24 to secure the L-shaped arm 22 to the stationary base 29. The tubular end 23 of the arm 22 has a hinge pin 38 extending therethrough. The stationary base 29 is provided with a plurality of holes 39 for screws by which it is mounted to a furniture wall 40.

In order to mount the hinge as hereinabove described, the mounting member 21 is embedded in an appropriate portion of the furniture door 41, and after the door 41 is applied to the door opening of the furniture, the stationary base 29 is provisionally positioned relative to the furniture wall 40, and its position is marked thereon. Then, the central insert 35 is engaged in the stationary base 29, and the stationary base 29 is secured to the marked position on the wall 40. Then, the bifurcated portion 24 of the L-shaped arm 22 is placed in the grooves 31 of the stationary base 29, and after the door 41 is set in its properly closed position, the mounting screws 26 are engaged into the internally threaded holes 37 of the central insert 35 through the slot 25 of the L-shaped arm 22. The screws 26 push down the insert 35, and the heads of the screws 26 press on the shoulders 27 along the edges of the slot 25, whereby the L-shaped arm 22 is firmly secured to the stationary base 29. The connection between the arm 22 and the base 29 is further enhanced by the engagement of the teeth 28 on the bifurcated portion 24 with the teeth 32 in the grooves 31 of the base 29.

Figure 6:
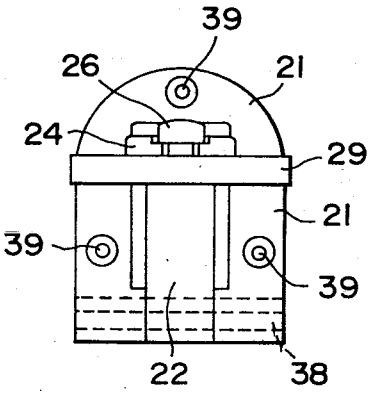
FIG. 6 is a top plan view of FIG. 5.

If it is, then, desired to adjust the closing operation of the door 41, the screws 26 are loosened, and the door 41 is moved in either direction of the arrows X—X shown in FIGS. 6 and 8, whereby the bifurcated portion 24 is moved in the same direction, and the screws 26 move the central insert 35. As the central insert 35 has a width w which is smaller than the width W of the opening 30, it is transversely moved as its projections 36 remain slidably engaged in the grooves 34 of the base 29. Accordingly, the L-shaped arm 22 is movable for its transverse adjustment as desired within the range defined by the difference between the widths W and w.

If it is desired to adjust the longitudinal position of the L-shaped arm 22 in the direction of the arrows Y—Y, the screws 26 are loosened again, and the door 41 is moved in either direction of the arrows Y—Y to or away from the wall 40. The shoulders 27 of the arm 22 are slidingly moved past the studs of the screws 26, whereby the bifurcated portion 24 can be displaced in any desired direction of the arrows Y—Y. The minimum magnitude of such positional adjustment for the door 41 depends on the width of the teeth 28 on the bifurcated portion 24 and the teeth 32 in the grooves 31.

According to this invention, the maintenance of the projections 36 of the central insert 35 in engagement with the grooves 34 of the stationary base 29 during the sliding movement of the insert 35 for the transverse positional adjustment of the L-shaped arm 22 in the direction of the arrows X—X advantageously facilitates such adjustment, and ensures firm connection after adjustment, thereby enabling the hinge to remain in a proper position for a long time, as opposed to any prior art hinge having elongated or oval holes for the mounting screws, or having a mounting base formed with an elongated slot in which a spring washer is engaged. Likewise, the provision of the teeth 28 and 32 engaged with each other for the longitudinal adjustment of the arm 22 in the direction of the arrows Y—Y assures a higher force of retention than any prior art arrangement, thereby preventing any displacement of the arm 22 due to external force, and allowing the use of the hinge for the frequently repeated opening and closing operation.

The hinge as hereinabove described with reference to FIGS. 5 to 8 provides further advantages, if it includes an arrangement for permitting the door to close automatically, as hereinbefore described with reference to FIG. 2. This arrangement can be realized if the tubular end 23 of the arm 22 is formed with a pair of flat cam surfaces facing the legs of the mounting member 21, and maintained in intimate contact with a pair of cam rests urged outwardly of the legs of the mounting member 21 by a pair of coil springs.

While the invention has been described with reference to the particular embodiments thereof, it will be understood that numerous modifications may be made by those skilled in the art without departing from the spirit and scope of this invention as defined in the appended claims.

What is claimed is:

1. A hinge comprising:

an L-shaped stationary flap having a pair of legs each formed with a recess;

an L-shaped rotatable flap having a leg disposed between said legs of said stationary flap and defining a pair of oppositely directed cam shafts projecting from the opposite ends, respectively, of said leg of said rotatable flap;

each of said legs having a rounded, tubular end formed with an axial hole which also extends through said cam shafts which are received in said recesses;

a hinge pin extending through said axial hole;

each of said cam shafts having a flat surface;

a cam rest provided in each said recess and contacting said flat surface of one of said cam shafts; and a spring provided in each said recess for urging one of said cam rests outwardly to maintain said one cam rest in intimate contact with each said cam shaft.

2. A hinge as set forth in claim 1, wherein said cam rests are made of a synthetic resin.

3. A hinge as set forth in claim 1, wherein each of said flaps is made of a metal selected from the group consisting of brass and aluminum.

4. A hinge as set forth in claim 1, wherein said flaps are made by casting.

* * * * *